US005390723A

United States Patent [19]

Mohla et al.

[11] Patent Number: 5,390,723

[45] Date of Patent: Feb. 21, 1995

[54] METHOD OF TREATING CASTING METALS

[76] Inventors: Prem P. Mohla, 27546 Sherwood Dr., Westlake, Ohio 44145; Eli David, 117 Hunt Club Dr., Apt. 1B, Copley, Ohio 44321

[21] Appl. No.: 137,894

[22] Filed: Oct. 18, 1993

Related U.S. Application Data

[63] Continuation of Ser. No. 848,530, Mar. 9, 1992, abandoned.

[51] Int. Cl.[6] ..... B22C 9/08; B22D 1/00; B22D 27/20

[52] U.S. Cl. ..... 164/57.1; 164/270.1; 164/349; 164/358; 164/134

[58] Field of Search ..... 164/55.1, 56.1, 57.1, 164/58.1, 59.1, 270.1, 358, 349, 134

[56] References Cited

U.S. PATENT DOCUMENTS

| | | | |
|---|---|---|---|
| 3,658,115 | 4/1972 | Ryntz, Jr. et al. | 164/57.1 |
| 3,703,922 | 11/1972 | Dunks et al. | 164/57.1 |
| 3,730,252 | 5/1973 | Schnurrenberger | 164/134 |
| 3,746,078 | 7/1973 | Moore et al. | 164/57.1 X |
| 4,779,668 | 10/1988 | Nagel et al. | 164/58.1 X |
| 4,802,527 | 2/1989 | Brockmeyer et al. | 164/358 |
| 4,836,270 | 6/1989 | Smith | 164/134 |
| 4,949,774 | 8/1990 | Keough et al. | 164/134 X |
| 4,955,427 | 9/1990 | Hitchings | 164/358 |
| 5,033,531 | 7/1991 | Fisher et al. | 164/358 X |

FOREIGN PATENT DOCUMENTS

| | | | |
|---|---|---|---|
| 0048529 | 3/1982 | European Pat. Off. | 164/57.1 |
| 0249897 | 12/1987 | European Pat. Off. | 164/58.1 |
| 61-216840 | 9/1986 | Japan | 164/57.1 |
| 62-244550 | 10/1987 | Japan | 164/58.1 |
| 64-27740 | 1/1989 | Japan | 164/58.1 |
| 1405943 | 6/1988 | U.S.S.R. | 164/349 |

OTHER PUBLICATIONS

"Inmold Nodulization with Delayed Pouring in Vertically Parted Molds", R. Sillen; AFS Trans. 1979, vol. 76, pp. 191–194.

*Primary Examiner*—J. Reed Batten, Jr.

*Attorney, Agent, or Firm*—Vorys, Sater, Seymour and Pease

[57] ABSTRACT

Metallurgically treated metal castings are produced using a consumable plug assembly made of a meltable material which is placed in a reaction chamber in an open treating basin and above a passage to a molding cavity. The consumable plug assembly has physical and chemical characteristics which maintain the plugged relationship for a preselected retaining period. All of a treating material is placed on the plug in the reaction chamber prior to metal pouring so as to react directly with the poured metal in a non-dynamic way.

8 Claims, 1 Drawing Sheet

METHOD OF TREATING CASTING METALS

This is a continuation of application Ser. No. 07/848,530, filed on Mar. 9, 1992, now abandoned.

BACKGROUND OF THE INVENTION

The present invention relates generally to the field of metal founding and, more particularly, to an improved method and system for treating and casting metals.

Heretofore, a number of techniques have been proposed for treating cast metals alloys, such as the various ferrous metal alloys. These include sandwich, tundish, flotret (registered trademark), sigmat (registered trademark), and inmold (registered trademark) processes which form the bulk of the processes used in the ductile iron processing. Among all these different processes the inmold process achieves the highest treatment efficiency. In the inmold process, which this invention comes closest to, chemically reactive agents are introduced into a molding assembly prior to pouring of the casting metal so as to treat such metals prior to entering the molding cavities, thereby imparting certain characteristics to the cast metal. For example, in the casting of ferrous metals, the treating chemicals can include magnesium and rare earths.

The present invention relates to an improvement over heretofore known methods, for instance, the inmold process using vertically parted mold cavities for the production of nodular ductile iron castings. Due to several difficulties experienced in the practical utilization of the inmold process on vertically parted molds, different versions of the treatment method have been tried in the past. In all cases the reaction chamber is located directly underneath or close to the pouring cup to facilitate the alloy addition. In the more popular version, for example, chemical reactive agents, such as certain nodularizing alloys containing modifiers, such as calcium and magnesium, are introduced into a separate reaction chamber which is separate from the receiving basin. The reaction chamber is offset with respect to a receiving basin in the initial part of a runner system leading to the molding cavity. In this approach, the treatment operation commences with passing the molten metal through a reaction chamber which chamber has a specific amount of treating material therein, for example magnesium ferrosilicon, in order to react with cast iron. A meltable metal plug is inserted in the bottom of the receiving basin directly over a downsprue leading to the molding cavity. This is done in order to restrain flow to the molding cavity for a time sufficient to alloy the treating material with the molten metal to be cast. Until the metal plug melts, the poured metal is retained in the basin for a preselected period of time so that the reaction products and other inclusions travel to the surface of the metal. After the plug melts, the treated molten metal enters the casting cavities.

While there are advantages to this approach, there are, however, a number of shortcomings. For example, the pouring rate has to be rigorously controlled in order to insure that the treating chemical reagents generally uniformly react with the molten metal in a controlled manner before entering the treating basin. However in practice, effecting this control is often relatively difficult to achieve and relatively complicated gating systems are used. Moreover, this approach tends to limit the usable mold space for castings and, therefore, the metal yield per mold due to the reaction chamber being located separately from the basin. In addition, the treatment of the metal is not as homogeneous as it could otherwise be. There is also a certain loss of metal temperatures due to the greater volume of the gating system.

While such techniques have overall provided improvements in casting processes, there is nevertheless a continuing desire to improve upon them.

SUMMARY OF THE INVENTION

The present invention provides a process and system for overcoming shortcomings of the prior art and for enhancing the treating and casting of metals.

According to the present invention, there is provided an improved method and system of treating metals. Included is a step of providing a melt of the metal to be cast; providing a molding assembly which includes at least a molding cavity for receiving and molding the molten metal; providing an open-top treating basin in the molding assembly for receiving directly poured metal and for allowing metallurgical treatment of the molten metal prior to the metal being introduced to the cavity; providing a reaction chamber in the molding assembly which is in direct open communication with the basin and which chamber is intermediate the basin and the molding cavity and upstream of passage means leading to the molding cavity; plugging the passage means by a consumable plug assembly having physical and chemical characteristics which are meltable by the molten metal and alloyed therewith to thereby open the passage means and allow the molten material into the molding cavity. The properties of the consumable plug assembly will maintain the plugged relationship for a preselected period of time until melting so as to allow metallurgical treatment of the molten metal by a treating chemical. Melting of the plug opens the passage means for allowing the treated metal to be introduced into the molding cavities.

In an illustrated embodiment, the pouring of the molten metal is directly into the open basin by manual as well as an automatic pouring mechanism.

In another illustrated embodiment of the invention, provision is made for a casting process for production of cast iron. In this embodiment, the chemically reactive treating materials that are commonly called inoculants are introduced in the reaction chamber so as to react with the molten cast iron to thereby facilitate inoculation treatment thereof. The reaction time allows metal to homogenize and reaction products to rise to the top of the metal in the basin. In this illustrated embodiment, the consumable plug assembly is a steel disc which will melt after the noted time period so as to open the passage means to the molding cavities.

The present invention also contemplates a system for achieving the noted process. As a consequence of the foregoing, there is provided an inexpensive, relatively uncomplicated process and system which economically produce cast metals, such as grey, compacted and ductile cast irons and the like.

Among the objects of the invention are the provisions of an improved method and system of providing a casting process for production of metal castings; the provisions of an improved method and system for providing a reaction chamber in the molding assembly which is in direct open communication with a treating basin and which reaction chamber is intermediate the basin and molding cavity and upstream of passage means leading to the molding cavity; the provisions of an improved method and system in which the treating chemicals which, metallurgically treat the molten metal to be cast, are in the reaction chamber; the provisions of an improved method and system in which the molten metal is poured directly into the basin; the provisions of an improved method and system in which the metallurgical treating substances generally homogeneously treat the molten metal to be cast in the basin; the provisions of an improved process and system which enable casting of metals using relatively uncomplicated gating procedures; the provisions of an improved process and system of the aforenoted type which utilize a reaction chamber in a manner which facilitates the increased production of the molding process per mold; the provisions of an improved process and system of the aforenoted type which enhances the versatility of the treating process, such as with inoculation of the molten metal to be cast; the provisions of an improved process and system which allow for increasing mold space utilization; the provisions of an improved process and system which utilize a consumable plug assembly which plugs the flow of the poured casting metal via the passage means to the cavities until after a predetermined retaining time period has elapsed, whereby the plug is consumed by the molten metal to allow flow to the cavities; the provisions of an improved process and system for providing enhanced production capabilities for vertically parted molds; the provisions of an improved process and system of the foregoing type which allow for the automatic pouring of the cast metal into an open basin therefor; the provisions of an improved process and system wherein the open basin minimizes the degree of control required over the pouring rate of the molten metal; the provisions of an improved process and system of the foregoing type in which the metal to be cast is treated fully in the basin; and, the provisions of an improved process and system which are relatively uncomplicated and inexpensive.

Other objects and further scope of applicability of the present invention will become apparent from the detailed description to follow when taken in conjunction with the accompanying drawings in which like parts are designated by like reference numerals throughout the several views.

DETAILED DESCRIPTION

Figure 1:
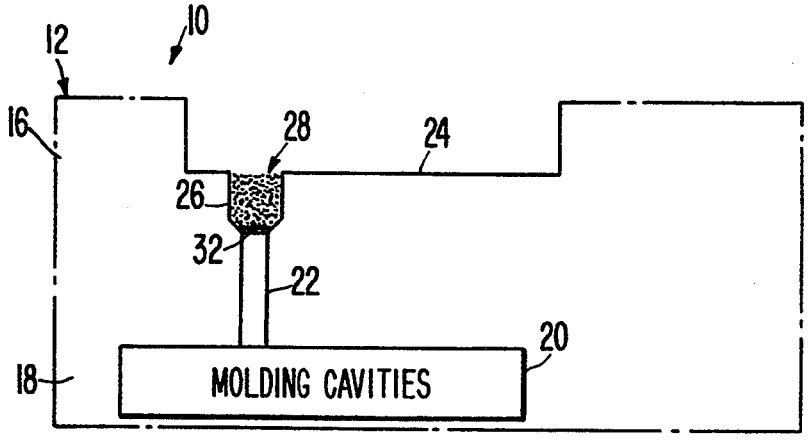
FIG. 1 is a diagrammatic view of one step of a process of casting metal in accordance with the present invention.

Reference is now made to FIGS. 1–4 for purposes of illustrating one preferred embodiment of a casting system embodying the principles the present invention and being generally designated by reference numeral 10. The process of the present invention lends itself particularly well to vertically parted molds, but can, of course, be used with horizontally parted molds as well. In an illustrated embodiment, however an inmold type casting system 10 is utilized, such as a disamatic type molding system. Other molding systems consistent with the present invention are contemplated. The casting system 10 includes a vertically parted mold assembly 12 having an upper mold portion 16 and a lower mold portion 18. The lower mold portion 18 includes a plurality of molding cavities which have been designated generally by reference numeral 20. A wide variety of molding cavities 20 for casting molten metal are, of course, contemplated by the present invention.

With continued reference to FIGS. 1–4, there is seen located in the upper mold portion 16 a downsprue or a runner system 22 which has a sufficient size to allow non-turbulent flow of the molten metal into the molding cavities 20. There is provided an open top receptacle or treating basin 24 which is appropriately dimensioned to receive the entire amount of molten metal to at least fill the cavities 20. Accordingly, the volume of the basin 24 will vary depending on the volume of the molding cavities 20. The basin 24 is open at the top for allowing direct pouring thereinto of the molten metal. The pouring is, preferably, automatic. This minimizes the deleterious effects of pyrotechnics.

Formed in open communication with the bottom wall of the treating basin 24 is an integrally formed reaction chamber 26. The reaction chamber dimensions are predetermined to yield the desired alloying with the given treatment agents under practical metal pouring temperatures. Molten metal will directly enter the reaction chamber 26 when poured. In the casting of metals and in this instance ferrous metals, it is desirable to treat the molten metal with metallurgical treating alloys 28, in order to impart different desired properties in the resulting castings. Therefore, the kind and amount of treating alloy 28 will, of course, vary depending upon the metal being cast and the properties which are intended to be imparted in the castings. The various types of metallurgical treatment materials do not form a part of the present invention and thus details thereof are not necessary for understanding the invention.

In the illustrated embodiment, cast iron castings are to be produced. In this regard, the metallurgical treating material 28 can be a nodularizing or an inoculating agent which is selected from a group of materials in a silicon carrier comprising magnesium, calcium, lithium, barium, cerium, didynium, lanthanum and yttrium. The physical condition of the nodularizing agents employed maybe in either lump, crushed, solid shaped, aggregate or powdered form. The kind, size, and shape of the nodularizer particles and the quantity required will, as is readily understood, depend on a number of parameters including, for example, the size and shape of the reaction chamber 26, and the molten metal temperature and the metallurgical characteristics of the castings required.

Figure 2:
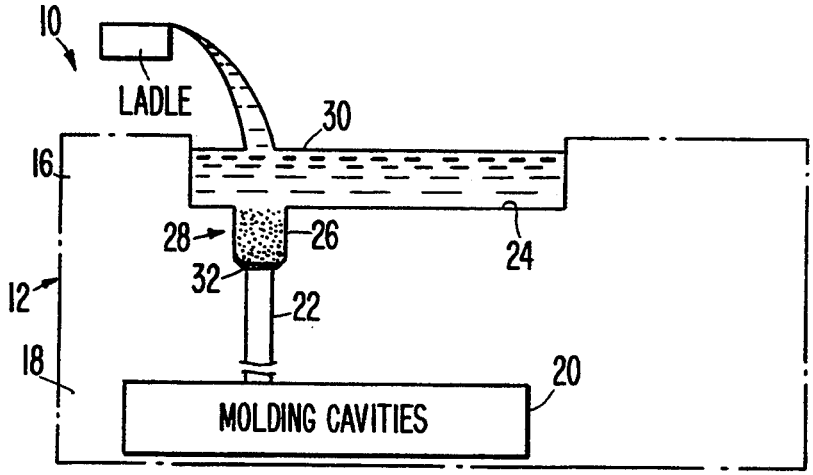
FIG. 2 is another diagrammatic view of another step of a system in process made according to the present invention.
Figure 3:
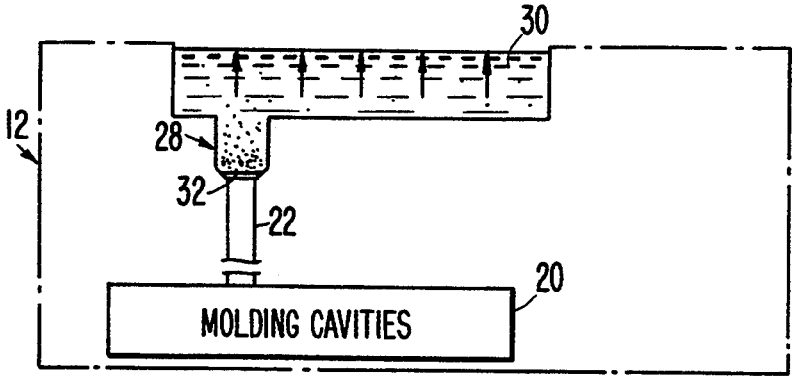
FIG. 3 is a diagrammatic view of an improved casting process and system made according to the present invention.
Figure 4:
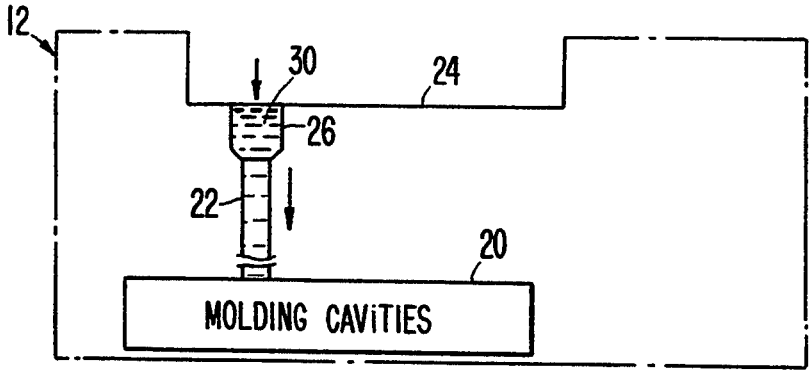
FIG. 4 is a diagrammatic view depicting another step in the improved casting process and system of the present invention.

Because of the molding arrangement, as seen in FIG. 2 the molten cast iron metal 30 can be poured directly into the basin 24 and, of course, the reaction chamber 26 as well. It will be appreciated, of course, that the poured molten metal 30 relatively quickly fills the volume of both the basin 24 and the reaction chamber 26 in a manner such that the pouring rate of the molten metal need not be controlled to the same demanding extent as is known in conventional inmolding techniques and relatively complicated gatings systems need not be formed. Because the treating material 28 has been placed in the reaction chamber 26 and there is direct communication with the poured metal 30 in a relatively non-dynamic situation, the treating material reacts relatively homogeneously throughout the molten metal 30. This approach enhances treatment distribution. An additional virtue of the reaction chamber 26 being positioned integrally within the bottom of the basin 24 is the fact that the treating material 28 is all consumed and utilized for the casting of the part and not left unused as can happen in the conventional inmolding techniques. Accordingly, the molten metal 30 is more thoroughly treated. Moreover, with automatic pouring techniques and the noted molding construction, pyrotechnics, turbulence and fumes are generally absent.

With continued reference to the drawings, the reaction chamber 26 is positioned directly above the downsprue or the runner system 22 which, as noted, is in direct fluid communication with the molding cavities 20. Seated in the bottom of the reaction chamber 26 is a plug assembly 32 for plugging the basin 24 and the chamber 26. The plug assembly 32 is initially placed in the bottom of the reaction chamber 26 so as to retain the treating alloys and the molten metal 30 in the basin 24 for a predetermined holding time. The plug 32 prevents the molten metal 30 from descending into the molding cavities 20 until the necessary treating reactions occur by virtue of the treating alloys 28 placed in the reaction chamber 26. The plug 32 is constructed to melt after a predetermined time period and alloy with the molten metal in the basin 24. Accordingly, the temperature of the molten metal 30 is high enough to cause the plug 32 to be consumed thereby. Once the melting is practically completed, the downsprue 22 opens thus allowing the retained and treated molten metal 30 to flow into the molding cavities 20. It will be appreciated that the flow is non-turbulent.

In the present embodiment, it is, of course, highly desirable to provide a retaining period for the molten metal 30 which adequately ensures the desired metal treatment. In the present embodiment for the production of ductile or grey iron, the plug 32 is a steel disc-shaped member having the necessary thickness and diameter which allows it to be placed at the bottom of the reaction chamber 26 directly above the downsprue 22. The size of the disc used depends upon the metal temperature being cast; dwell time required and the desired fill time of the mold cavities. The plug 32 will remain unconsumed, until adequate temperatures of the molten cast iron melt it. In this embodiment, the retaining period is generally for about five (5) seconds so that the treating alloy 28, containing magnesium ferrosilicon can react completely with the molten cast iron 30. While a steel disc is shown, other materials such as ceramic/cloth filters can also be used underneath the steel disc to permit additional cleaning of the metal. It will be appreciated that until the steel plug 32 is melted, the treating alloys 28 in the reaction chamber 26 are able to be more homogeneously distributed throughout the molten metal 30 held in the reaction chamber 26. This contributes significantly to enhanced casting quality. Furthermore, the reaction products will, in the form of slag, rise to the top of the basin 24 during this retaining period. While a steel plug is preferred, the invention envisions use of plugs of different materials.

In addition, with this approach, the metal per mold yield enhances significantly. The inoculant or treating material sizing and chemical formulation is less critical than in the conventional inmold process, recovery is higher and there is no need for complicated gatings. If desired for treating larger amounts of molten material, a separate receptacle can be added to the top of the molding assembly.

Certain changes may be made in the above described system and method without departing from the scope of the invention involved and it is intended that all matter contained in the description thereof or shown in the accompanying drawing shall be interpreted as illustrative and not in a limiting sense.

What is claimed:

1. A casting process for production of metallurgically treated metal castings, comprising the steps of:

providing molten metal of proper chemistry to be cast;

providing a molding assembly which includes at least a molding cavity for receiving and molding the molten metal;

providing an open top treating basin in association with the molding assembly for directly receiving poured molten metal;

providing at least a reaction chamber adjacent a bottom of the treating basin and which reaction chamber is intermediate the basin and the molding cavity, the reaction chamber being coupled to the molding cavity by passage means and adapted to progressively dissolve a treating alloy in the molten metal;

temporarily plugging the passage means by a consumable plug assembly having physical and chemical characteristics which maintain a plugged relationship for a preselected retaining period before melting to allow for generally uniform treatment and homogenization of the molten metal by the treating alloy;

providing all of the treating alloy in exposed form in the reaction chamber prior to pouring of the molten metal in the basin, the treating alloy directly metallurgically reacting in a generally non-dynamic manner with the molten metal to be cast, said step of providing all of the treating alloy in exposed form effectively limiting the exposure of the treating alloy to the molten metal and minimizing flotation and burning of the treating alloy in the molten metal;

pouring the molten metal directly in the basin and reaction chamber so as to generally uniformly react with the treating alloy in a gentle boiling or mixing action facilitating the uniformity of reaction, the retaining period also sufficient to minimize flotation of undesirable products to the surface of the molten metal;

said step of temporarily plugging the passage means including using a plug material having physical and chemical characteristics sufficient to prevent the plug assembly from melting to thereby retain the molten metal in the treating basin for the preselected retaining period to ensure generally uniform reaction of the treating alloy.

2. The process of claim 1 wherein the step of temporarily plugging comprises the substep of providing a filter for purposes of cleaning the molten metal.

3. The process of claim 1 wherein the open treating basin has a volume which is sufficient to hold the molten metal for purposes of filling the molding cavity.

4. The process of claim 1 wherein the molten metal to be cast is a ferrous metal.

5. The process of claim 4 wherein the ferrous metal is cast iron.

6. The process of claim 5 wherein the treating alloy is from a group of materials comprising silicon, magnesium, lithium, barium, cerium, didynium, lanthanum, yttrium, and calcium.

7. The process of claim 2 wherein the plug assembly includes a steel disc.

8. The process of claim 1 wherein the treating alloy is completely consumed while the molten metal is in the basin.

* * * * *